US005782937A

United States Patent [19]

Colucci et al.

[11] Patent Number: 5,782,937

[45] Date of Patent: Jul. 21, 1998

[54] GASOLINE COMPOSITIONS CONTAINING IGNITION IMPROVERS

[75] Inventors: William J. Colucci; Isaac L. Smith, both of Glen Allen; Allen A. Aradi, Richmond, all of Va.

[73] Assignee: Ethyl Corporation, Richmond, Va.

[21] Appl. No.: 858,316

[22] Filed: May 19, 1997

[51] Int. Cl.[6] ..... C10L 1/18; C10L 1/22

[52] U.S. Cl. ..... 44/324; 44/325; 44/359; 44/413

[58] Field of Search ..... 44/324, 325, 359, 44/413

[56] References Cited

U.S. PATENT DOCUMENTS

| | | | |
|---|---|---|---|
| 2,324,779 | 7/1943 | Kass | 44/324 |
| 2,645,079 | 7/1953 | Doumani et al. | 44/324 |
| 2,764,477 | 9/1956 | Risk | 44/324 |
| 3,732,283 | 5/1973 | Cummings | 44/324 |
| 4,328,005 | 5/1982 | Frankel et al. | 44/324 |

FOREIGN PATENT DOCUMENTS 8203097 6/1983 South Africa .

OTHER PUBLICATIONS

S. K. Fulcher et al., "The Effects of Fuel Atomization, Vaporization, and Mixing on the Cold-Start UHC Emissions of a Contemporary S.I. Engine with Intake-Manifold Injection." SAE Paper No. 952482, date unavailable.

Smith, J. "Add nitropropane to Pump Gas and Gain 20 Horsepower", *Hot Rod*, Jan. 1996, pp. 66–69.

*Primary Examiner*—Jacqueline V. Howard

*Attorney, Agent, or Firm*—Dennis H. Rainear; Thomas Hamilton

[57] ABSTRACT

The present invention relates to fuel compositions containing hydrocarbon fuels in the gasoline boiling range and organic nitrogen-containing compounds selected from organic nitrates and/or organic nitro compounds. The fuel compositions exhibit improved ignition properties, including reduced emissions and reduced misfires.

11 Claims, 2 Drawing Sheets

Cold-Start HC Emissions

From RUL Gasoline

Cold-Start HC Emissions

From RUL Gasoline

GASOLINE COMPOSITIONS CONTAINING IGNITION IMPROVERS

TECHNICAL FIELD

This invention relates to the use of organic nitrates and/or organic nitro compounds in gasoline compositions. Further, the present invention is directed to gasoline compositions which exhibit improved ignition properties and reduced cold-start emissions.

BACKGROUND

According to Fulcher et al., in the paper entitled *The Effects of Fuel Atomization, Vaporization, and Mixing on the Cold-Start UHC Emissions of a Contemporary S.I. Engine with Intake-Manifold Injection*, a modem automobile powered by a spark ignition engine produces approximately 80% of its total tailpipe unburned hydrocarbon emissions during the first five minutes of the half-hour FTP 75 driving cycle used for federal automotive emissions standards. As this cycle represents the trip length characteristic of approximately half of the vehicle miles traveled in the United States, efforts must focus on this "cold-start transient" if both regulated and actual automotive hydrocarbon emissions are to be reduced.

Many attempts have been made to reduce hydrocarbon emissions resulting from cold-start. Most of these attempts have been concerned with modifications of the engine itself and in the manner that the fuel is delivered. It has now been discovered that hydrocarbon emissions, resulting from cold-start ignition, can be improved by the use of additives in the gasoline formulation, specifically organic nitrogen containing compounds selected from organic nitrates and/or organic nitro compounds.

Organic nitrates and organic nitro compounds have been added to diesel fuels, as cetane improvers, for years. Since the 1930's, organic nitrates have been used in diesel fuels to increase cetane number and thereby achieve a level of auto-ignition sufficient to allow the operation of the diesel engine.

For fuels boiling in the gasoline range, used in spark-ignition internal combustion engines, it is desired that they have a sufficient octane number so as to resist auto-ignition.

SUMMARY OF THE INVENTION

It has been discovered that the use of organic nitrogen-containing compounds selected from organic nitrates and/or organic nitro compounds, in gasoline, at specific treat rates, results in improved ignition properties and therefore benefits fuel economy, cold start ignition, lean burn, and emissions. Improved ignition properties are evidenced by the reduction or complete elimination of engine misfires. The addition of organic nitrogen containing compounds typically thought of as cetane improvers to gasoline appears counterintuitive. Since additives which increase the cetane number of diesel fuels are known to be pro-knock agents when added to gasoline, the discovery that the addition of an organic nitrate compound or an organic nitro compound to gasoline, at specific treat rates, will not negatively affect fuel octane and at the same time will improve the ignition properties of the fuel is surprising.

The present invention includes fuel compositions comprising a major amount of hydrocarbons in the gasoline boiling range with which has been blended from about 1 to about 1000 ppm of at least one organic nitrogen-containing compound selected from the group consisting of organic nitrates, organic nitro compounds and mixtures thereof.

Further, the present invention includes a method for improving the ignition properties of a spark-ignition internal combustion engine, wherein said method comprises adding to and combusting in said engine a fuel composition comprising a major amount of a hydrocarbon in the gasoline boiling range and a minor amount of an organic nitrogen-containing compound selected from the group consisting of organic nitrates, organic nitro compounds and mixtures thereof.

Another embodiment of the present invention is directed to a method for reducing misfires in spark-ignition internal combustion engines, said method comprising adding to and combusting in said engine a fuel composition comprising a major amount of a hydrocarbon in the gasoline boiling range and a minor amount of an organic nitrogen-containing compound selected from the group consisting of organic nitrates, organic nitro compounds and mixtures thereof.

Misfires occur upon non-optimal-ignition of the fuel due to short spark or partial combustion of the fuel due to poor air-to-fuel ratios. These phenomena often occur during cold-start and transient operations. Misfires result in higher emissions and lower fuel economy as a result of the loss of unburnt fuel. Misfire-free cold-starts are highly desirable in order to reduce emissions and improve fuel economy. The compositions of the present invention make misfire-free cold-starts possible.

Further, the compositions of the present invention can reduce, and even prevent, partial combustion of the fuel. By ensuring complete combustion of the fuel, the levels of unburnt hydrocarbon emissions are reduced and fuel economy is improved.

In another embodiment of the present invention, the nitrogen-containing compounds are added to fuels containing a major amount of a hydrocarbon in the gasoline boiling range, in order to improve cycle-to-cycle variation. Cycle-to-cycle variations occur as a result of uneven combustion, either among cylinders, or for consecutive cycles for a single cylinder. The fuel compositions of the present invention promote a more even combustion and thereby can reduce the cycle-to-cycle variation.

DETAILED DESCRIPTION

Figure 1:
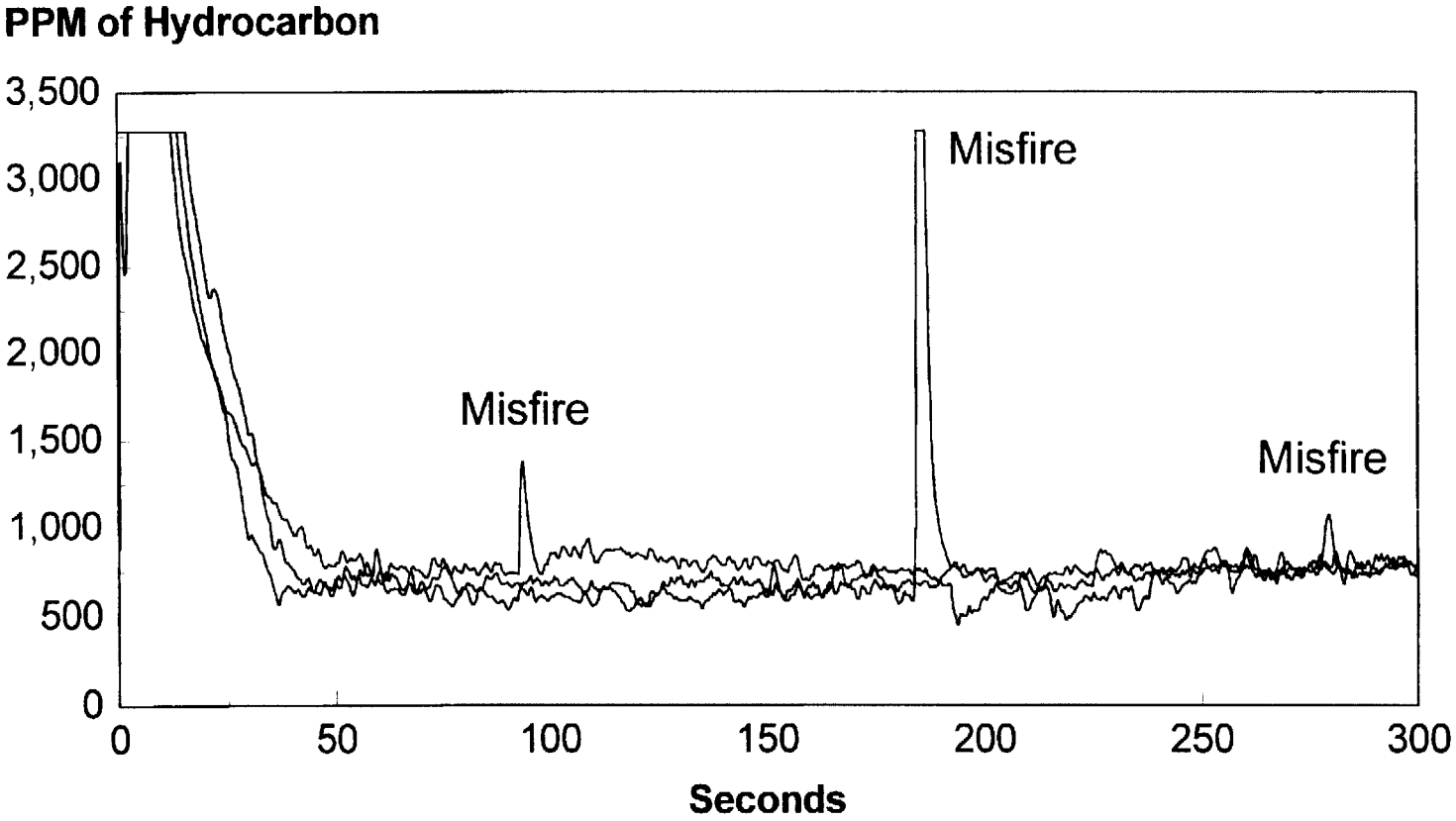
FIG. 1 shows cold-start hydrocarbon emissions as a function of time for three unadditized regular unleaded (RUL) gasolines. The spikes in the plot represent engine misfires as indicated by the sharp increases in hydrocarbon emissions.

The ignition improver of the present invention is an organic nitrogen-containing compound selected from at least one organic nitrate, at least one organic nitro compound or mixtures thereof. Preferred organic nitrates are substituted or unsubstituted alkyl, cycloalkyl, or aryl nitrates having up to about 10 carbon atoms, preferably from 2 to 10 carbon atoms. The alkyl group may be either linear or branched. Specific examples of nitrate compounds suitable for use in the present invention include, but are not limited to the following:

methyl nitrate ethyl nitrate n-propyl nitrate isopropyl nitrate allyl nitrate n-butyl nitrate isobutyl nitrate sec-butyl nitrate tert-butyl nitrate n-amyl nitrate isoamyl nitrate 2-amyl nitrate 3-amyl nitrate tert-amyl nitrate n-hexyl nitrate 2-ethylhexyl nitrate n-heptyl nitrate sec-heptyl nitrate n-octyl nitrate sec-octyl nitrate n-nonyl nitrate n-decyl nitrate n-dodecyl nitrate cyclopentylnitrate cyclohexylnitrate methylcyclohexyl nitrate isopropylcyclohexyl nitrate and the nitrate esters of alkoxy substituted aliphatic alcohols, such as 1-methoxypropyl-2-nitrate, 1-ethoxypropyl-2-nitrate, 1-isopropoxybutyl nitrate, 1-ethoxybutyl nitrate, and the like. Preferred alkyl nitrates are ethyl nitrate, propyl nitrate, amyl nitrates and hexyl nitrates. Other preferred alkyl nitrates are mixtures of primary amyl nitrates or primary hexyl nitrates. In the present invention, primary means that the nitrate functional group is attached to a carbon atom which is attached to two hydrogen atoms. Examples of primary hexyl nitrates would be n-hexyl nitrate, 2-ethylhexyl nitrate, 4-methyl-n-pentyl nitrate and the like. Preparation of the nitrate esters may be accomplished by any of the commonly used methods, such as, for example, esterification of the appropriate alcohol, or reaction of a suitable alkyl halide with silver nitrate.

Preferred organic nitro compounds include, but are not limited to, nitrotoluenes and dinitrotoluenes.

The organic nitrogen containing compound can be present in the gasoline in any amount which does not negatively affect the fuel octane and which promotes improved ignition. Preferably, the organic nitrogen containing compound are present in the gasoline formulations in an amount of about 1 to about 1000 ppm on a volume/volume basis, more preferably from about 10 to about 300 ppm, and most preferably from about 50 to 100 ppm.

The gasolines utilized in the practice of this invention can be traditional blends or mixtures of hydrocarbons in the gasoline boiling range, or they can contain oxygenated blending components such as alcohols and/or ethers having suitable boiling temperatures and appropriate fuel solubility, such as methanol, ethanol, methyl tert-butyl ether (MTBE), ethyl tert-butyl ether (ETBE), tert-amyl methyl ether (TAME), and mixed oxygen-containing products formed by "oxygenating" gasolines and/or olefinic hydrocarbons falling in the gasoline boiling range. Thus this invention involves use of gasolines, including the so-called reformulated gasolines which are designed to satisfy various governmental regulations concerning composition of the base fuel itself, componentry used in the fuel, performance criteria, toxicological considerations and/or environmental considerations. The amounts of oxygenated components, detergents, antioxidants, demulsifiers, and the like that are used in the fuels can thus be varied to satisfy any applicable government regulations, provided that in so doing the amounts used do not materially impair the improved ignition performance made possible by the practice of this invention.

While not required for the purpose of this invention, it is preferred that the fuel compositions of this invention include other additives such as one or more cyclopentadienyl manganese tricarbonyl compounds, detergents, antioxidants, demulsifiers, corrosion inhibitors and/or metal deactivators. Accordingly, such optional, but preferred, components for use in the formulations of this invention will now be described.

Cyclopentadienyl Manganese Tricarbonyl Compounds

Compounds of this type are exceptionally useful for providing combined benefits to the fuel. These compounds have the ability of effectively raising the octane quality of the fuel. In addition, these compounds effectively reduce undesirable tailpipe emissions from the engine. Illustrative cyclopentadienyl manganese tricarbonyl compounds suitable for use in the practice of this invention include such compounds as cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of such compounds is described in the literature, e.g., U.S. Pat. No. 2,818,417.

Detergents

Any of a number of different types of suitable gasoline detergent additives can be included in the gasoline fuel compositions of this invention. These detergents include succinimide detergent/dispersants, long-chain aliphatic polyamines, long-chain Mannich bases, and carbamate detergents.

Desirable succinimide detergent/dispersants for use in gasolines are prepared by a process which comprises reacting an ethylene polyamine such as diethylene triamine or triethylene tetramine with at least one acyclic hydrocarbyl substituted suc-cinic acylating agent. The substituent of such acylating agent is characterized by containing an average of about 50 to about 100 (preferably about 50 to about 90 and more preferably about 64 to about 80) carbon atoms. Additionally, the acylating agent has an acid number in the range of about 0.7 to about 1.3 (e.g., in the range of 0.9 to 1.3, or in the range of 0.7 to 1.1), more preferably in the range of 0.8 to 1.0 or in the range of 1.0 to 1.2, and most preferably about 0.9. The detergent/dispersant contains in its molecular structure in chemically combined form an average of from about 1.5 to about 2.2 (preferably from 1.7 to 1.9 or from 1.9 to 2.1, more preferably from 1.8 to 2.0, and most preferably about 1.8) moles of the acylating agent per mole of said polyamine. The polyamine can be a pure compound or a technical grade of ethylene polyamines which typically are composed of linear, branched and cyclic species.

The acyclic hydrocarbyl substituent of the detergent/dispersant is preferably an alkyl or alkenyl group having the requisite number of carbon atoms as specified above. Alkenyl substituents derived from poly-olefin homopolymers or copolymers of appropriate molecular weight (e.g., propene homopolymers, butene homopolymers, $C_3$ and $C_4$-olefin copolymers, and the like) are suitable. Most preferably, the substituent is a polyisobutenyl group formed from polyisobutene having a number average molecular weight (as determined by gel permeation chromatography) in the range of 700 to 1200, preferably 900 to 1100, most preferably 940 to 1000. The established manufacturers of such polymeric materials are able to adequately identify the number average molecular weights of their own polymeric materials. Thus in the usual case the nominal number average molecular weight given by the manufacturer of the material can be relied upon with considerable confidence.

Acyclic hydrocarbyl-substituted succinic acid acylating agents and methods for their preparation and use in the formation of succinimide are well known to those skilled in the art and are extensively reported in the patent literature. See for example the following U.S. Pat. Nos.:

3,018,247 3,231,587 3,399,141 3,018,250 3,272,746 3,401,118 3,018,291 3,287,271 3,513,093 3,172,892 3,311,558 3,576,743 3,184,474 3,331,776 3,578,422 3,185,704 3,341,542 3,658,494 3,194,812 3,346,354 3,658,495 3,194,814 3,347,645 3,912,764 3,202,678 3,361,673 4,110,349 3,215,707 3,373,111 4,234,435 3,219,666 3,381,022 5,071,919

Use of fuel-soluble long chain aliphatic polyamines as induction cleanliness additives in distillate fuels is described for example in U.S. Pat. Nos. 3,438,757; 3,454,555; 3,485,601; 3,565,804; 3,573,010; 3,574,576; 3,671,511; 3,746,520; 3,756,793; 3,844,958; 3,852,258; 3,864,098; 3,876,704; 3,884,647; 3,898,056; 3,950,426; 3,960,515; 4,022,589; 4,039,300; 4,128,403; 4,166,726; 4,168,242; 5,034,471; and 5,086,115; and published European Patent Application 384,086.

Use in gasoline of fuel-soluble Mannich base additives formed from a long chain alkyl phenol, formaldehyde (or a formaldehyde precursor thereof), and a polyamine to control induction system deposit formation in internal combustion engines is described for example in U.S. Pat. No. 4,231,759.

Carbamate fuel detergents are compositions which contain polyether and amine groups joined by a carbamate linkage. Typical compounds of this type are described in U.S. Pat. No. 4,270,930. A preferred material of this type is commercially available from Chevron Chemical Company as OGA-480 additive.

Antioxidants

Various compounds known for use as oxidation inhibitors can be utilized in the practice of this invention. These include phenolic antioxidants, amine antioxidants, sulfurized phenolic compounds, and organic phosphites, among others. For best results, the antioxidant should be composed predominately or entirely of either (1) a hindered phenol antioxidant such as 2,6-di-tert-butylphenol, 4-methyl-2,6-di-tert-butylphenol, 2,4-dimethyl-6-tert-butylphenol, 4,4'-methylenebis(2,6-di-tert-butylphenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more such amine antioxidants. Particularly preferred for use in the practice of this invention are combinations of tertiary butyl phenols, such as 2,6-di-tert-butylphenol, 2,4,6-tri-tert-butylphenol and o-tert-butylphenol. Also useful are N,N'-di-lower-alkyl phenylenediamines, such as N,N'-di-sec-butyl-p-phenylenediamine, and its analogs, as well as combinations of such phenylenediamines and such tertiary butyl phenols.

Demulsifiers

A wide variety of demulsifiers are available for use in the practice of this invention, including, for example, organic sulfonates, polyoxyalkylene glycols, oxyalkylated phenolic resins, and like materials. Particularly preferred are mixtures of alkylaryl sulfonates, polyoxyalkylene glycols and oxyalkylated alkylphenolic resins, such as are available commercially from Petrolite Corporation under the TOLAD trademark. One such proprietary product, identified as TOLAD 286K, is understood to be a mixture of these components dissolved in a solvent composed of alkyl benzenes. This product has been found efficacious for use in the compositions of this invention. A related product, TOLAD 286, is also suitable. In this case the product apparently contains the same kind of active ingredients dissolved in a solvent composed of heavy aromatic naphtha and isopropanol. However, other known demulsifiers can be used.

Corrosion Inhibitors

Here again, a variety of materials are available for use in the practice of this invention. Thus, use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols.

Also useful are the aminosuccinic acids or derivatives thereof represented by the formula:

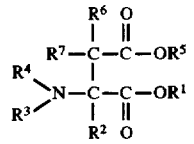

wherein each of $R^1$, $R^2$, R, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms.

The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched- chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

Metal Deactivators

If desired, the fuel compositions of this invention may contain a conventional type of metal deactivator of the type having the ability to form complexes with heavy metals such as copper and the like. Typically, the metal deactivators used are gasoline soluble N,N'-disalicylidene-1,2-alkanediamines or N,N'-disalicylidene-1,2-cycloalkanediamines, or mixtures thereof. Examples include N,N'-disalicylidene-1,2-ethanediamine, N,N'-disalicylidene-1,2-propanediamine, N,N'-disalicylidene-1,2-cyclo-hexanediamine, and N,N"-disalicylidene-N'-methyl-dipropylene-triamine.

The various additives that can be included in the gasoline compositions of this invention are used in conventional amounts. Thus, the amounts of such optional additives are not critical to the practice of this invention. The amounts used in any particular case are sufficient to provide the desired functional property to the fuel composition, and such amounts are well known to those skilled in the art.

According to the present invention, the organic nitrogen containing compound can be added to the gasoline or fuel containing gasoline either directly or in the form of an additive concentrate. The additive concentrate can comprise the organic nitrate, a solvent or diluent oil, and optionally, but preferably the various additives described above.

EXAMPLES

Six samples of the identical 87 octane fuel were tested. Three samples were tested without additive and three samples had 100 ppm, on a volume/volume basis, of 2-ethylhexyl nitrate added. Engine out emissions were measured from one exhaust bank.

Figure 2:
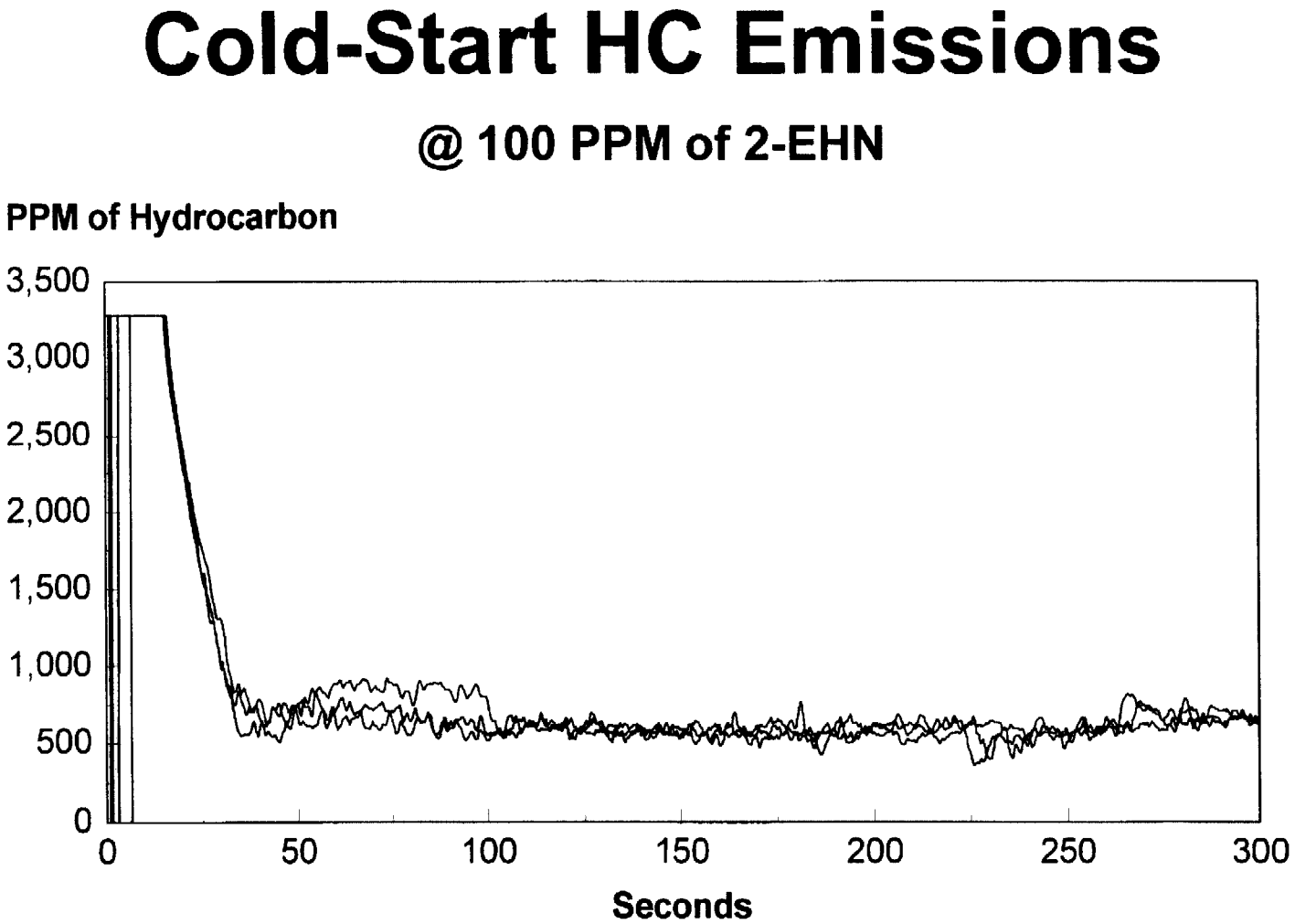
FIG. 2 shows cold-start hydrocarbon emissions as a function of time for three RUL gasolines containing 100 ppm of 2-ethylhexyl nitrate. The fuels containing the nitrate exhibit no misfires, therefore the levels of unburnt hydrocarbon emissions are reduced relative to the emission levels of FIG. 1.

FIG. 1 shows cold-start hydrocarbon emissions as a function of time for three unadditized regular unleaded (RUL) gasolines. The spikes in the plot represent engine misfires as indicated by the sharp increases in hydrocarbon emissions. FIG. 2 shows cold-start hydrocarbon emissions as a function of time for three RUL gasolines containing 100 ppm of 2-ethylhexyl nitrate. The fuels containing the nitrate exhibit no misfires, therefore the levels of unburnt hydrocarbon emissions are reduced relative to the emission levels of FIG. 1.

Throughout this disclosure, reference is made to various issued patents, patent publications and technical literature. All such documents are incorporated by reference herein in toto as if fully set forth herein.

The term "gasoline soluble" herein means that the additive material in question can be dissolved in the gasoline fuel being treated to at least the concentration necessary for the additive material to perform its desired function. Preferably, the additive material will have a solubility in excess of this minimum value. However, the term "gasoline soluble" does not mean that the material must be soluble in all proportions in the gasoline fuel composition.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

We claim:

1. A fuel composition containing a major amount of hydrocarbons in the gasoline boiling range with which has been blended from about 1 to about 1000 ppm of at least one organic nitrogen-containing compound selected from the group consisting of:

(a) organic nitrates, selected from the group consisting of alkyl, cycloalkyl and aryl nitrates having up to 10 carbon atoms and nitrate esters of alkoxy substituted aliphatic alcohols;

(b) organic nitro compounds, selected from the group consisting of nitrotoluenes and dinitrotoluenes; and (c) mixtures thereof;

wherein the hydrocarbons in the gasoline boiling range is unleaded gasoline.

2. The fuel composition of claim 1 wherein the organic nitrogen-containing compound is present in an amount of about 10 to about 300 ppm.

3. The fuel composition of claim 1 wherein the organic nitrogen-containing compound is present in an amount of about 50 to about 100 ppm.

4. The fuel composition of claim 1 wherein the organic nitrogen-containing compound is a substituted or unsubstituted alkyl nitrate.

5. The fuel composition of claim 4 wherein the organic nitrogen-containing compound is 2-ethylhexyl nitrate.

6. The fuel composition of claim 1 further comprising at least one member selected from the group consisting of cyclopentadienyl manganese tricarbonyl compounds, detergents, antioxidants, demulsifiers, corrosion inhibitors and/or metal deactivators.

7. The fuel composition of claim 1 further comprising oxygenated blending components such as alcohols and/or ethers having suitable boiling temperatures and appropriate fuel solubility.

8. A method for improving the ignition properties of a spark-ignition internal combustion engine, wherein said method comprises adding to and combusting in said engine a fuel composition according to claim 1.

9. A method of reducing misfire in a spark-ignition internal combustion engine, wherein said method comprises adding to and combusting in said engine a fuel composition according to claim 1.

10. A method of preventing partial combustion in a spark-ignition internal combustion engine, wherein said method comprises adding to and combusting in said engine a fuel composition according to claim 1.

11. A method of improving cycle-to-cycle variation in a spark-ignition internal combustion engine, wherein said method comprises adding to and combusting in said engine a fuel composition according to claim 1.

* * * * *